US006659849B1

(12) United States Patent
Li et al.

(10) Patent No.: US 6,659,849 B1
(45) **Date of Patent: *Dec. 9, 2003**

(54) PLATEN WITH DEBRIS CONTROL FOR CHEMICAL MECHANICAL PLANARIZATION

(75) Inventors: Shijian Li, San Jose, CA (US); Jayakumar Gurusamy, Newark, CA (US); Manoocher Birang, Los Gatos, CA (US); Fred C. Redeker, Fremont, CA (US)

(73) Assignee: Applied Materials Inc., Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/705,965

(22) Filed: Nov. 3, 2000

(51) Int. Cl.[7] ..... B24B 1/00

(52) U.S. Cl. ..... 451/72; 451/444; 451/443; 451/56; 451/41; 451/296; 451/307

(58) Field of Search ..... 451/444, 72, 443, 451/56, 41, 296, 299, 307, 312, 324; 134/1, 6, 9, 15, 21, 26, 30, 37

(56) References Cited

U.S. PATENT DOCUMENTS

| | | | | | |
|---|---|---|---|---|---|
| 4,594,748 | A | * | 6/1986 | Warfvinge | 134/15 |
| 4,672,985 | A | * | 6/1987 | Mohr | 134/57 |
| 5,190,064 | A | * | 3/1993 | Aigo | 134/84 |
| 5,578,529 | A | | 11/1996 | Mullins | 437/228 |
| 5,611,281 | A | * | 3/1997 | Corrato et al. | 101/425 |
| 5,628,672 | A | * | 5/1997 | Heesemann | 451/5 |
| 5,709,593 | A | | 1/1998 | Guthrie et al. | 451/287 |
| 5,716,264 | A | | 2/1998 | Kirmura et al. | 451/443 |
| 5,913,345 | A | * | 6/1999 | Corrato et al. | 15/3 |
| 6,006,843 | A | * | 12/1999 | Corrato et al. | 173/1 |
| 6,080,242 | A | * | 6/2000 | Gajewski | 134/15 |
| 6,162,113 | A | * | 12/2000 | Armstrong | 451/39 |
| 6,209,705 | B1 | * | 4/2001 | Drewitz | 198/404 |
| 6,244,944 | B1 | * | 6/2001 | Elledge | 451/296 |
| 6,273,800 | B1 | * | 8/2001 | Walker et al. | |
| 6,312,319 | B1 | * | 11/2001 | Donohue et al. | 451/56 |

FOREIGN PATENT DOCUMENTS

JP 9-29634 * 2/1997 ..... B24B/53/00

OTHER PUBLICATIONS

Butterfield et al., "Platen With Web Release Apparatus," USSN 09/676,395 filed Sep. 29, 2000.*

White et al. "Web Lift System for Chemical Mechanical Planarization" U.S. patent application Ser. No. 09/651,657, filed Aug. 29, 2000.

Birang et al. "Apparatus and Methods for Chemical Mechanical Polishing with an Advanceable Polishing Sheet" U.S. patent application serial No. 09/244,456, filed Feb. 4, 1999.

Rhine et al. "Titled Table on Chemical Mechanical Polishing System" U.S. patent application Ser. No. 09/640,502, filed Aug. 16, 2000.

* cited by examiner

*Primary Examiner*—George Nguyen
(74) *Attorney, Agent, or Firm*—Moser, Patterson & Sheridan

(57) ABSTRACT

Generally, a method and apparatus for cleaning a backside of a web of polishing material. In one embodiment, the apparatus includes a platen having a support surface adapted to support the backside the web and a web cleaner disposed on the platen and adjacent the backside of the web. A method for cleaning a web of polishing material is also provided. In one embodiment, the method includes the steps of supporting a portion of the web of polishing media on a platen, advancing a portion of the web onto the platen, and cleaning the unrolled portion of the web.

30 Claims, 8 Drawing Sheets

PLATEN WITH DEBRIS CONTROL FOR CHEMICAL MECHANICAL PLANARIZATION

CROSS REFERENCE TO OTHER RELATED APPLICATIONS

This application is related to U.S. patent application Ser. No. 09/651,657, filed Aug. 29, 2000, which is hereby incorporated by reference in its entirety.

BACKGROUND OF THE DISCLOSURE

1. Field of Invention

Embodiments of the present invention relate generally to a system and a method for controlling debris under a web in a polishing system.

2. Background of Invention

In semiconductor wafer processing, the use of chemical mechanical planarization, or CMP, has gained favor due to the enhanced ability to increase device density on a semiconductor workpiece, or substrate, such as a wafer. As the demand for planarization of layers formed on wafers in semiconductor fabrication increases, the requirement for greater system (i.e., process tool) throughput with less wafer damage and enhanced wafer planarization has also increased.

An exemplary CMP system that addresses these issues is described in U.S. Pat. No. 5,804,507, issued Apr. 15, 1998 by Tolles et al., which is incorporated by reference in its entirety. Tolles et al. discloses a CMP system having a planarization system that is supplied wafers from cassettes located in an adjacent liquid filled bath. A transfer mechanism, or robot, facilitates the transfer of the wafers from the bath to a transfer station. The transfer station generally contains a load cup that positions wafers into one of four processing heads mounted to a carousel. The carousel moves each processing head sequentially over the load cup to receive a wafer. As the processing heads are loaded, the carousel moves the processing heads and wafers through the planarization stations for polishing. The wafers are planarized by moving the wafers relative to a polishing material in the presence of polishing fluid. The polishing fluid typically contains chemicals that aid in the removal of material from the wafer. The mechanical aspect of the polishing process is generally provided by abrasives disposed either in the polishing fluid (i.e., slurry) or disposed on the polishing material. After completion of the planarization process, the wafer is returned back through the transfer station to the proper cassette located in the bath.

One type of polishing material that may be utilized for chemical mechanical polishing is known as a fixed abrasive material. The fixed abrasive material comprises a plurality of abrasive particles suspended in a resin binder that is disposed in discrete elements on a backing sheet. As the abrasive particles are contained in the polishing material itself, systems utilizing fixed abrasive material generally use polishing fluid that do not contain abrasives.

Fixed abrasive polishing material is generally available in stick-down form but is often utilized in the form of a web. Generally, the web is supported by a platen having a central or working area where the polishing process is performed. The used and unused portions of the web that are not disposed on the platen are stored in a supply roll and take-up roll coupled to the side of the platen. As the web is consumed over the course of polishing a number of wafers, the web is advanced to place an incremental length of unused web in the working area of the platen. The used portion of the web leaving the platen is generally wound on a take-up roll that is disposed on the side of the platen opposite the supply roll.

Depending on the material to be polished, the unused portion of the web can be conditioned before entering the working area. Conditioning exposes the abrasive particles that are disposed in the abrasive elements that comprise the web. Conditioning is essential for scratch defect control when polishing soft materials. The web is typically conditioned by removing a layer of resin disposed at the surface of the abrasive elements to expose some of the abrasive particles disposed therein, and more importantly, to remove pad asperities and flatten the top of the individual abrasive elements while establishing a uniform height between the abrasive elements across the pad.

Both debris created during polishing, conditioning and contamination generated by other sources must be controlled to ensure good polishing results. For example, debris such as particulates from the conditioning or polishing process may become disposed on the backside of the web that is exposed between the supply roll and the top of the platen. Particles on the backside of the web are transported by the web as it advances. Some of these particles eventually become disposed between the web and the subpad. Since fixed abrasive webs are typically thin and flexible, particulate under the web may cause a corresponding "high-spot" on the surface of the web. As light pressures used to hold the substrate against the web during polishing and the web and substrate have a low surface contact ratio, a high-spot on the web may create a large local contact force between the substrate and web as the substrate passes over the high-spot.

For example, on a system utilizing 2 psi of pressure to hold a patterned substrate against a web having an 18 percent contact ratio, the local pressure may be as high as 24 psi which is typically not great enough to cause a scratch. A particle under the web in such a system creates a high-spot that results in a force concentration that can greatly exceed 24 psi at the high-spot. This local force concentration results in scratching or other defects on the substrate's surface. In some cases, one or more of the fixed abrasive elements over-lying the particle may be fragmented or sheared from the web due to the force concentration above the particle. Due to the periodic web advancement, a single particle on the web can cause the abrasive elements to be fragmented and/or sheared from multiple locations which forms a pattern of defects on the web. All the sheared and/or fragmented abrasive elements can create additional scratches on the substrate. Therefore, the effect of a single particle on the web can greatly amplify scratching issues during polishing. Additionally, global planarization of the substrate may be compromised due to a high rate of material removal caused by both the high-spot and the portions of the web damaged by the force concentration thereon when that portion of the web was positioned above the particle.

Therefore, there is a need for a system that controls debris under a web in a polishing system.

SUMMARY OF INVENTION

One aspect of the invention generally provides an apparatus for cleaning a backside of a web of polishing material. In one embodiment, the apparatus includes a platen having a support surface adapted to support the backside of the web and a web cleaner disposed on the platen adjacent the backside of the web. In another embodiment, an apparatus comprises one or more webs of polishing material, one or more polishing heads, one or more platens and a web cleaner. Each polishing head is adapted to retain the substrate against a respective web. Each platen has a support surface that supports the web from the web's backside. The web cleaner is coupled to the platen and disposed against the backside of the web.

In another aspect of the invention, method for cleaning a web of polishing material is provided. In one embodiment, the method includes the steps of supporting a portion of the web of polishing media on a platen, advancing a portion of the web on to the platen, and cleaning a portion of a backside of the web.

BRIEF DESCRIPTION OF DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION OF INVENTION

Figure 1:
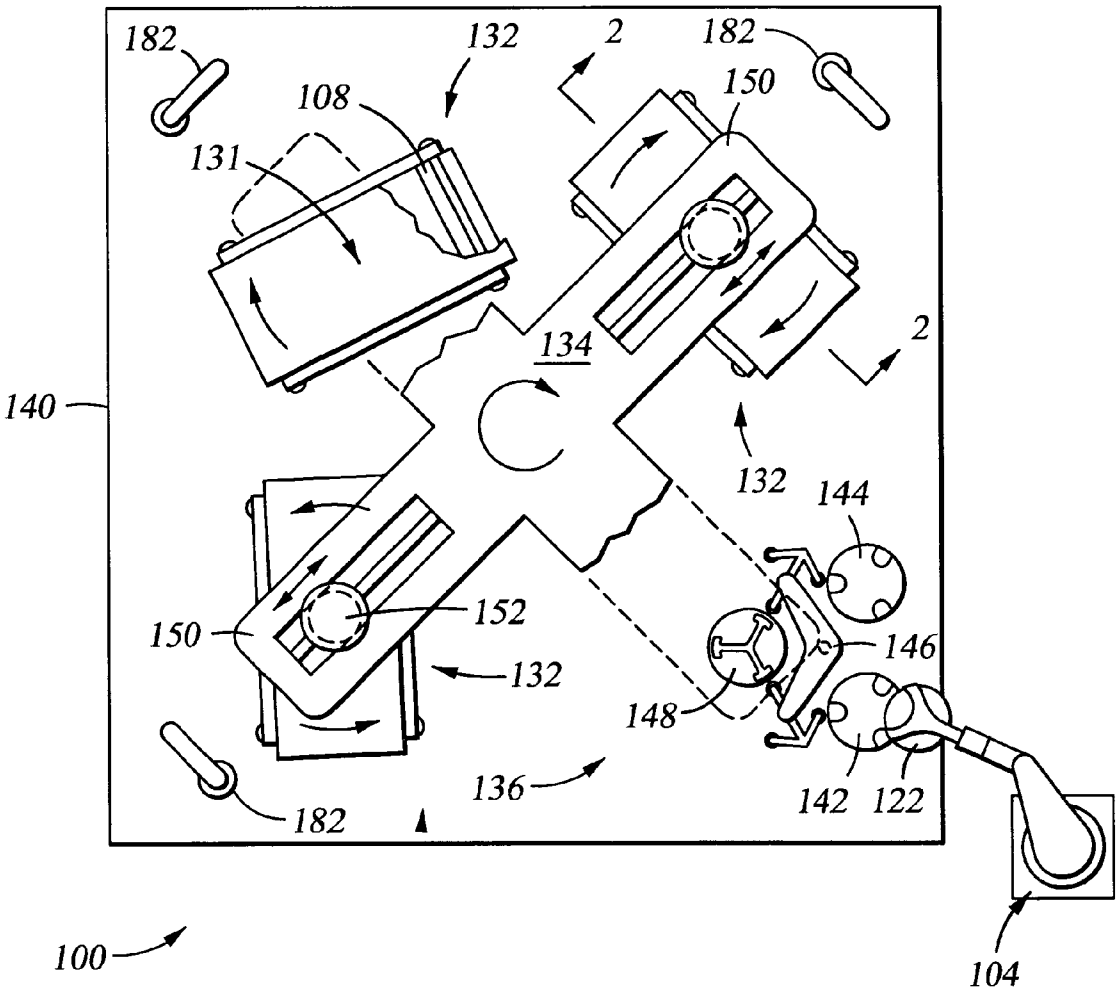
FIG. 1 is a plan view of a chemical mechanical planarization system of the invention.

FIG. 1 depicts a plan view of one embodiment of a chemical mechanical polisher 100 having one or more web cleaners 108. One polisher 100 that can be used to advantage with the present invention is a REFLEXIONS™ Chemical Mechanical Polisher, manufactured by Applied Materials, Inc., located in Santa Clara, Calif. Although the web cleaners 108 are described on one configuration of a chemical mechanical polisher, one skilled in the art may adapt web cleaners 108 as taught and described herein to be employed on other chemical mechanical polishers that utilize webs of polishing material.

An exemplary polisher 100 in which the invention may be used to advantage is generally described in U.S. patent application Ser. No. 09/244,456, filed Feb. 4, 1999 to Birang et al., which is incorporated by reference in its entirety. The polisher 100 generally comprises a loading robot 104, a transfer station 136, a plurality of polishing stations 132, a base 140 and a carousel 134 that supports a plurality of polishing head assemblies 152. Generally, the loading robot 104 is disposed proximate the polisher 100 and a factory interface (not shown) to facilitate the transfer of substrates 122 therebetween.

The transfer station 136 generally includes a transfer robot 146, an input buffer 142, an output buffer 144 and a load cup assembly 148. The input buffer station 142 receives a substrate 122 from the loading robot 104. The transfer robot 146 moves the substrate 122 from the input buffer station 142 and to the load cup assembly 148 where it may be transferred between the polishing head assembly 152. An example of a transfer station that may be used to advantage is described by Tobin in U.S. patent application Ser. No. 09/314,771, filed Oct. 6, 1999, which is hereby incorporated by reference.

Generally, the carousel 134 has a plurality of arms 150 that each support one of the polishing head assemblies 152. Two of the arms 150 depicted in FIG. 1 are shown in phantom such that a polishing surface 131 and the cleaner 108 of one of the polishing stations 132 and the transfer station 136 may be seen. The carousel 134 is indexable such that the polishing head assemblies 152 may be moved between the polishing stations 132 and the load cup assembly 148. Generally, a chemical mechanical polishing process is performed at each polishing station 132.

Generally, a conditioning device 182 is disposed on the base 140 adjacent each polishing station 132. The conditioning device 182 periodically conditions the polishing surface 131 to maintain uniform polishing results.

Figure 2:
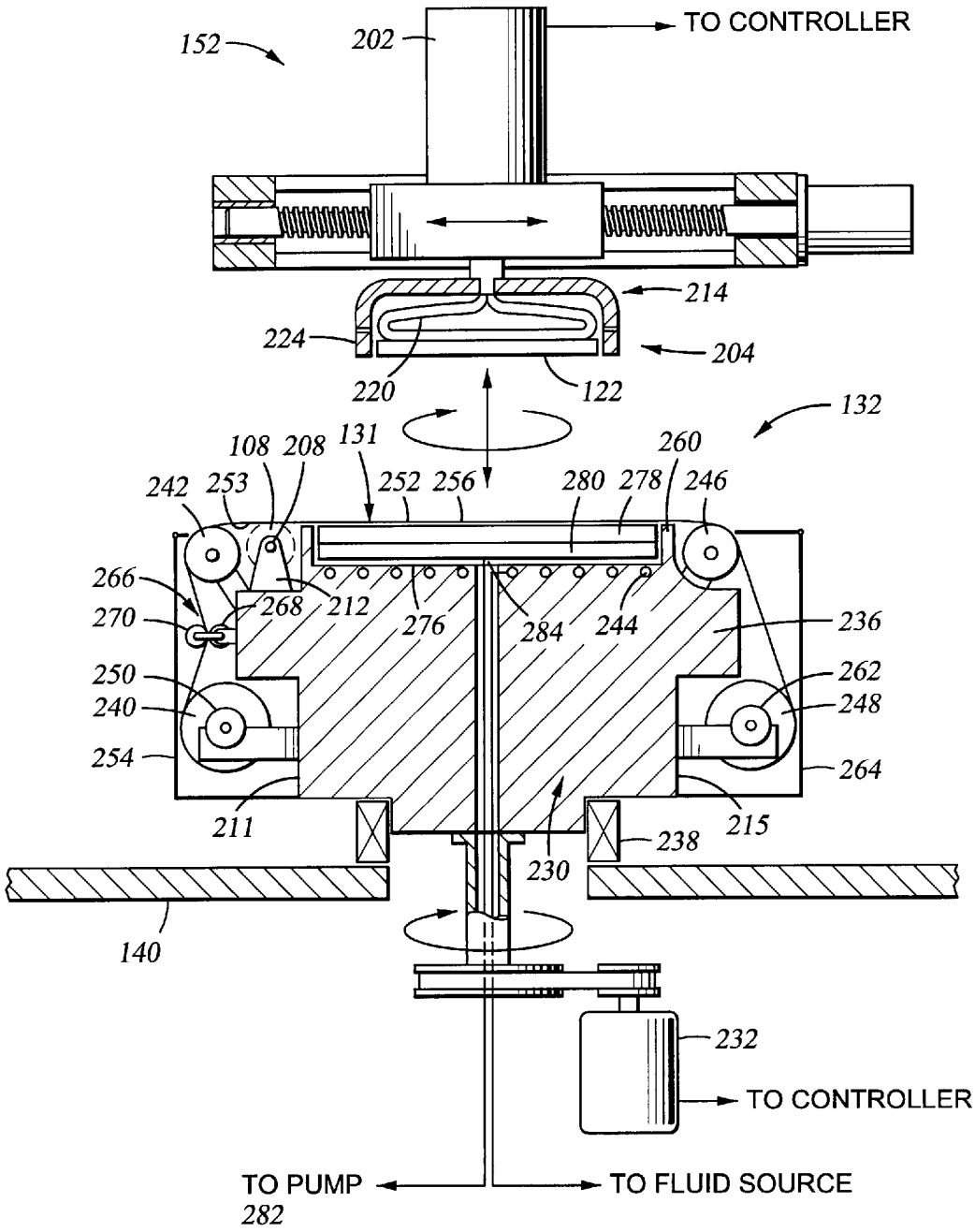
FIG. 2 is a sectional view of a polishing station taken along section line 2—2 of FIG. 1.

FIG. 2 depicts a sectional view of the polishing head assembly 152 supported above the polishing station 132.

The polishing head assembly 152 is generally coupled to the carousel 134 by a drive system 202. The drive system 202 generally provides motion to the polishing head 204 during processing.

In one embodiment, the polishing head 204 is a TITAN HEAD™ wafer carrier manufactured by Applied Materials, Inc., Santa Clara, Calif. Generally, the polishing head 204 comprises a housing 214 which is disposed a bladder 220. The bladder 220 may be controllably inflated or deflated. The bladder 220, when in contact with the substrate 122, retains the substrate 122 within the polishing head 204 by deflating, thus creating a vacuum between the substrate 122 and the bladder 220. A retaining ring 224 circumscribes the polishing head 204 to retain the substrate 122 within the polishing head 204 while polishing.

Disposed between the polishing head assembly 154 and the polishing station 132 is a web of polishing material 252. The web of polishing material 252 may have a smooth surface, a textured surface, a surface containing a fixed abrasive or a combination thereof. The web of polishing material 252 may be advanced across or releasably fixed to the polishing surface. Typically, the web of polishing material 252 is releasably fixed by adhesives, vacuum, mechanical clamps or by other holding methods to the polishing station 132.

The web of polishing material 252 generally has a polishing side 256 and a backside 258. The polishing side 256 may include fixed abrasives. Fixed abrasive typically comprises a plurality of abrasive particles suspending in a resin binder that is disposed in discrete elements on a backing sheet. Examples of such fixed abrasive pads are available from Minnesota Manufacturing and Mining Company, of Saint Paul, Minn. The web of polishing material 252 may optionally comprise conventional polishing material without fixed abrasives, for example, polyurethane foam available from Rodel Inc., of Newark, Del.

The polishing station 132 generally comprises a platen 230 that is rotatably disposed on the base 140. The platen 230 is typically comprised of aluminum. The platen 230 may be polygonal (i.e., rectangular) or circular. The platen 230 is supported above the base 140 by a bearing 238 so that the platen 230 may rotate in relation to the base 140. An area of the base 140 circumscribed by the bearing 238 is open and provides a conduit for the electrical, mechanical, pneumatic, control signals and connections communicating with the platen 230.

Conventional bearings, rotary unions and slip rings (not shown) are provided such that electrical, mechanical, pneumatic, control signals and connections may be coupled between the base 140 and the rotating platen 230. The platen 230 is typically coupled to a motor 232 that provides the rotational motion to the platen 230.

The platen 230 has an upper portion 236 that supports the web of polishing material 252. A top surface 260 of the platen 230 contains a center recess 276 extending into the top portion 236. The top portion 236 may optionally include a plurality of passages 244 disposed adjacent to the recess 276. The passages 244 are coupled to a fluid source (not shown). Fluid flowing through the passages 244 may be used to control the temperature of the platen 230 and the polishing material 252 disposed thereon.

A subpad 278 and a subplate 280 are disposed in the center recess 276. The subpad 278 is typically a plastic, such as polycarbonate or foamed polyurethane. Generally, the hardness or durometer of the subpad may be chosen to produce a particular polishing result. The subpad 278 generally maintains the polishing material 252 parallel to the plane of the substrate 122 held in the polishing head 204 and promotes global planarization of the substrate 122. The subplate 280 is positioned between the subpad 278 and the bottom of the recess 276 such that the upper surface of the subpad 278 is coplanar with the top surface 260 of the platen 230.

A vacuum port 284 is provided in the recess 276 and is coupled to an external pump 282. When a vacuum is drawn through the vacuum port 284, the air removed between the polishing material 252 and the subpad 278 causes the polishing material 252 to be firmly secured to the subpad 278 during polishing. An example of such a polishing material retention system is disclosed in U.S. patent application Ser. No. 09/258,036, filed Feb. 25, 1999, by Sommer et al., which is hereby incorporated by reference in its entirety. The reader should note that other types of devices may be utilized to releasably fix the polishing material 252 to the platen 230, for example releasable adhesives, bonding, electrostatic chucks, mechanical clamps and other releasable retention mechanisms.

Optionally, to assist in releasing the polishing material 252 from the subpad 278 and platen 230 prior to advancing the polishing material 252, surface tension caused by fluid that may be disposed between the subpad 278 and.the polishing material 252 is overcome by a blast of fluid (e.g., air) provided through the vacuum port 284 or other port (not shown) into the recess 276 by the pump 282 (or other pump). The fluid pressure within the recess 276 moves through apertures (not shown) disposed in the subpad 278 and subplate 280 and lifts the polishing material 252 from the subpad 278 and the top surface 260 of the platen 230. The polishing material 252 rides upon the cushion of fluid such that it may be freely indexed across the platen 230. Alternatively, the subpad 278 may be a porous material that permits gas (e.g., air) to permeate therethrough and lift the polishing material 252 from the platen 230. Such a method for releasing the web 252 is described in U.S. patent application Ser. No. 60/157,303, filed Oct. 1, 1999, by Butterfield, et al., and is hereby incorporated by reference in its entirety.

Mounted to a first side 211 of the platen 230 is a supply roll 240. The supply roll 240 generally contains a portion of the web of polishing media 252 wound thereon. The web of polishing media 252 is fed over a first member 242 and across the top surface 260 of the platen 230. The web of polishing media 252 is fed over a second member 246 and a take-up roll 248 disposed on a second side 215 of the platen 230. The members 242,246 may be a roller, a rod, a bar or other member configured to allow the web 252 to move thereover with minimal damage to the web, particulate generation or contamination of the web.

The supply roll 240 is removably coupled to the platen 230 to facilitate loading another unwind roll containing unused polishing media once the web of polishing media 252 is consumed over the course of polishing a number of substrates. The supply roll 240 is coupled to a slip clutch 250 or similar device that prevents the web of polishing media 252 from inadvertently unwinding from the supply roll 240. The supply roll 240 is covered by a housing 254 that protects the supply roll 240 from damage and contamination.

The take-up roll 248 generally is removably coupled to the platen 230 to facilitate removal of used polishing media that is wound thereon. The take-up roll 248 is coupled to a tensioning device 262 that keeps the web of polishing media 252 keeps taunt between the supply roll 240 and take-up roll 248. A housing 264 is disposed over the take-up roll 248 protects the take-up roll 248 from damage and contamination.

The web of polishing media 252 is advanced between the supply roll 240 and take-up roll 248 by an indexer 266. In one embodiment, the indexer 266 comprises a drive roller 268 and an idler 270 that pinches the web of polishing media 252 therebetween. The drive roller 268 generally is coupled to the platen 230. The drive roller 268 is connected to a control motor such as a stepper motor paired with an encoder (motor and encoder not shown). The indexer 266 enables a predetermined length of polishing web to be pulled off the supply roll 240 by drive roller 268 as the drive roller 268 is controllably rotated. A corresponding length of polishing web is wound on the take-up roll 248 as the web of polishing media 252 is advanced across the platen 230.

The cleaner 108 is generally coupled to the platen 230 proximate the first member 242. The backside 258 of the web 252 of polishing material is disposed over and typically contacts the cleaner 108 as the web 252 passes from the first member 242 to the top surface 260 of the platen 230. The cleaner 108 generally removes particulates that may be present on the backside 258 of the web 252 before that section of the web is advanced over the subpad 278.

In one embodiment, the cleaner 108 includes a roller that is coupled to the platen 230 by a bracket 212. The cleaner 108 has a center shaft 208 that permits the cleaner 108 to rotate in the bracket 212. The cleaner 108 may be covered by a tacky substance or adhesive. The adhesive disposed on the cleaner 108 to trap particles should remain sticky in wet conditions found on the polisher 100. The adhesive should also be selective as not impede web movement by capturing the web 252 to the cleaner 108.

In another embodiment, the cleaner 108 comprises a roller having a covering of double sided tape. As the advancing web 252 causes the cleaner 108 to rotate, particulates on the backside 258 the web 252 are adhered to the tape disposed on the cleaner 108. Once the entire web 252 has been used, the used cleaner 108 is replaced with a "fresh" or particle-free cleaner during the change out of the web 252.

Alternatively, the cleaner 108 can be a plate or roller that is electrostatically charged. The electrostatic charge of the cleaner 108 attracts particulates disposed on the backside 258 of the web 252 as the web passes thereover.

Figure 3:
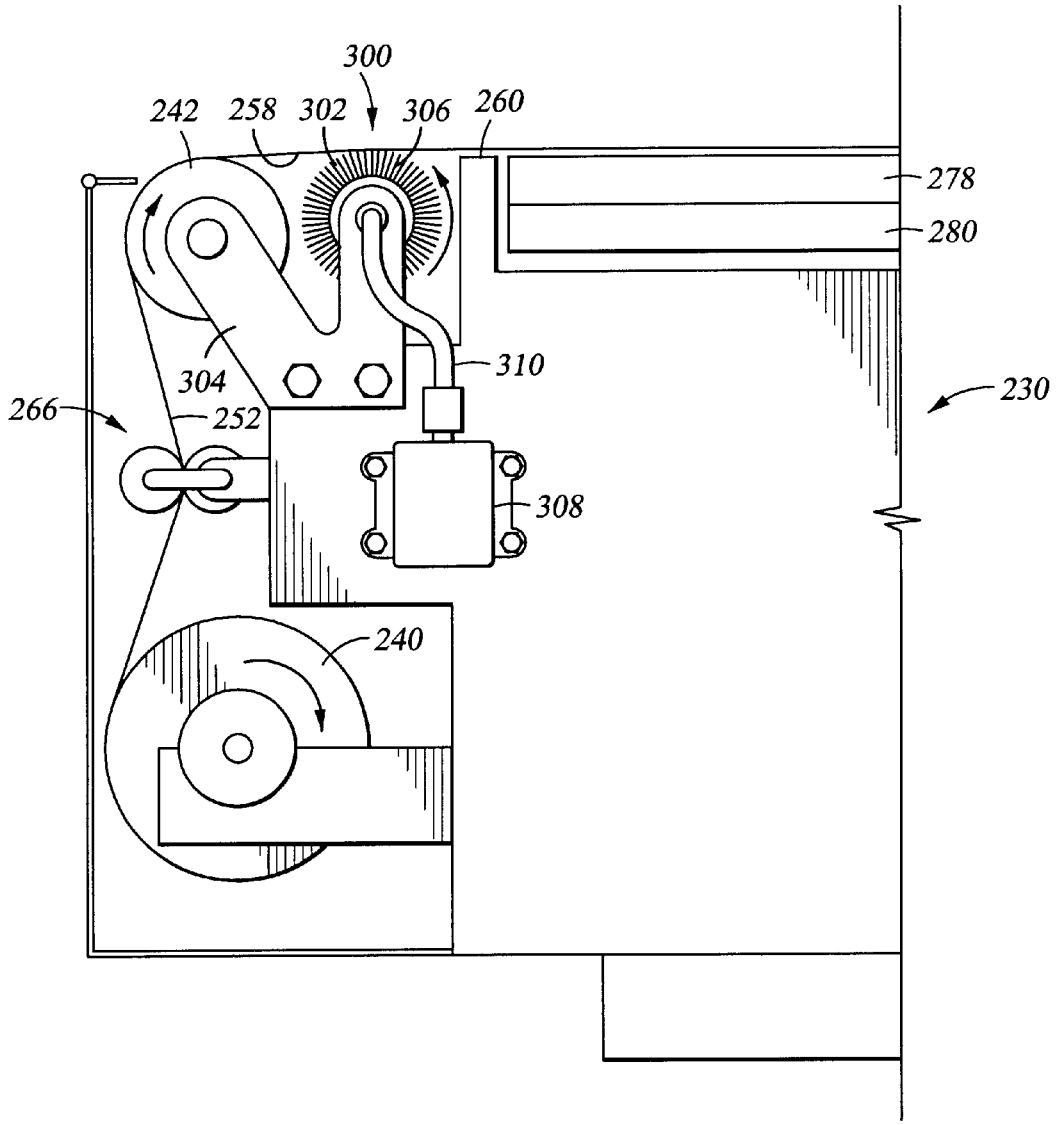
FIG. 3 is a sectional view of one embodiment of a cleaner.

FIG. 3 depicts another embodiment of a cleaner 300. The cleaner 300 comprises a brush 302 having bristles 306 extending therefrom. The brush 302 may be cylindrical (as shown) or flat. The brush 302 may be stationary or may be coupled to a device that provides movement to the brush. The brush 302 is generally coupled to the platen 230 by a bracket 304. The brush 302 is positioned such that bristles 306 extending from the brush 302 come in contact with the backside 258 of the web 252. Thus, as the web 252 is advanced across the cleaner 300, the bristles 306 remove the particles that may be present on the backside 258.

In one embodiment, the cleaner 300 is a cylindrical rush 302 that is rotated by a motor 308. The motor 308, for example an electrical or air motor, is generally disposed on the platen 230. The motor 308 is coupled to the brush 302 by a belt or flexible shaft 310. Other methods and devices may alternatively be employed to provided rotation to the cleaner 300, for example, solid shafts, timing belts, v-belts, gear assemblies, direct drives, pneumatic motors, stepper motors, pneumatic cylinders and other motion providing devices.

The motor 308 generally provides rotation to the brush 302 that is tangentially opposed to the direction of advancement of the web 252. Optionally, the brush 302 may be positioned such that the bristles 306 contact the roller 242 to remove particulates or other contamination that may be present on the roller 242.

Figure 4:
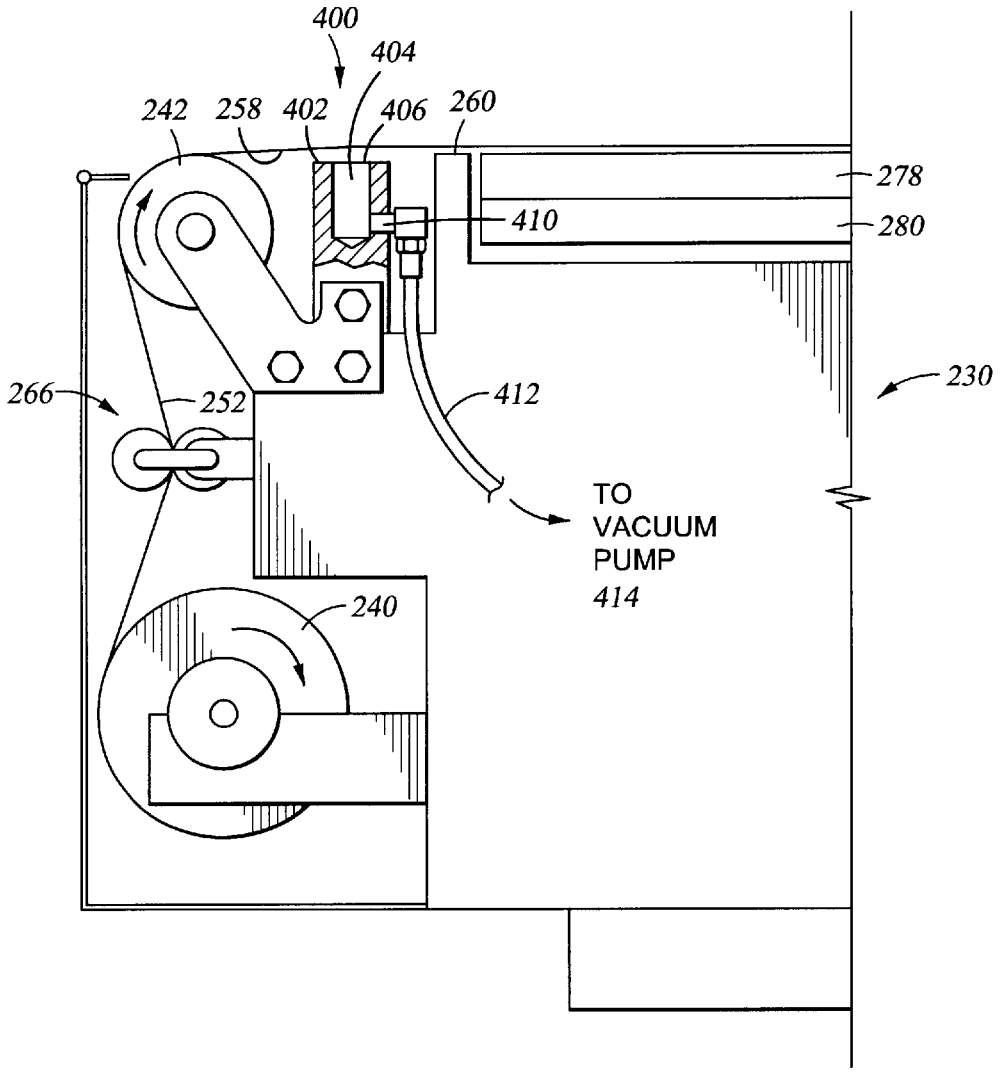
FIG. 4 is a sectional view of another embodiment of a cleaner.

FIG. 4 depicts another embodiment of a cleaner 400. The cleaner 400 generally comprises a vacuum block 402. The vacuum block 402 is typically coupled to the platen 230 by a bracket 408. The vacuum block 402 generally includes a slot or recess 404 that has an opening 406 that faces the backside 258 of the web 252. The vacuum block includes a port 410 that communicates with the recess 404. The port 410 is coupled to a vacuum pump 414 by a vacuum line 412.

The vacuum pump 414 applies a vacuum in the recess 404 when the web 252 is advanced. The vacuum pulls particles that may be disposed on the backside 258 of the web 252 through the opening 406, into the slot 404 and out the vacuum line 412. In this manner, particulates are substantially prevented from being disposed between the web 252 and the subpad 278.

Figure 5:
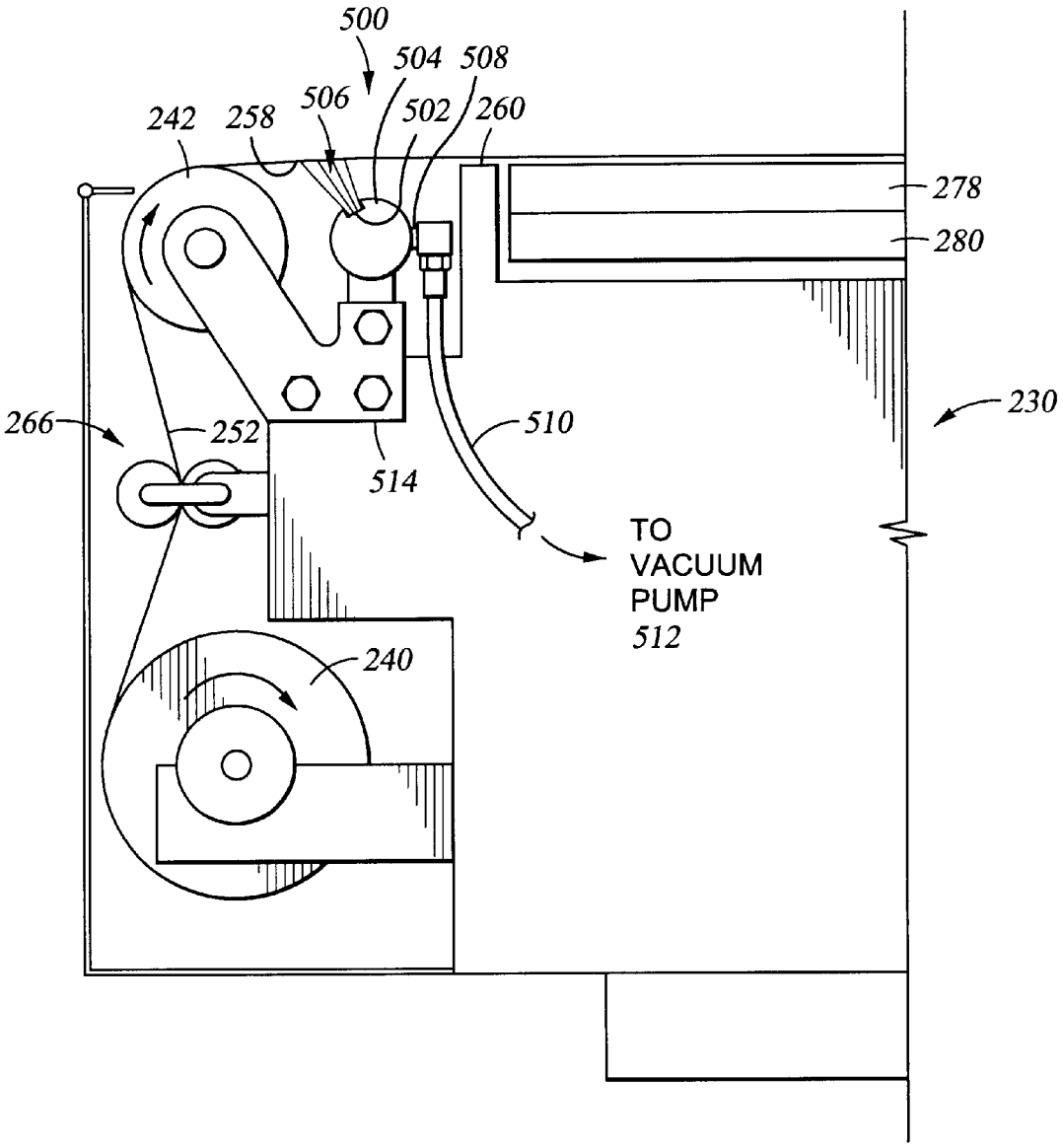
FIG. 5 is a sectional view of another embodiment of a cleaner.

FIG. 5 depicts another embodiment of a cleaner 500. The cleaner 500 is generally a fluid delivery tube 504 having at least one aperture 502 disposed therein. The tube 504 is typically disposed across the platen 230 under the web 252. The fluid delivery tube 504 includes a port 508 that is coupled to a fluid source 512 via a supply line 510. The fluid delivery tube 504 is coupled to the platen 230 by a bracket 514. The bracket 514 positions the fluid delivery tube 504 so that the aperture 502 directs a spray 506 of fluid to the backside 258 of the web 252. Alternatively, the delivery tube 504 may be mounted proximate the edge of the web 252 or platen 230 in an orientation that projects the spray 506 laterally across the backside 258 of the web 252. The spray 506 removes particulate that may be disposed on the backside 258 of the web 252. The fluid comprising the spray 506 may include deionized water, nitrogen, ionized air or other fluids. Alternatively, the tube 504 may be positioned elsewhere (i.e., out from under the web 252) as long as the one or more apertures 502 directs the spray 506 across the complete width of the backside 258 of the web 252.

In one embodiment, the spray 506 comprises ionized air. The spray 506 of ionized air may be reversed in polarity such that at one time the spray 506 substantially comprises predominantly positive ions while at another instance, the spray 506 comprises predominantly negative ions. The application of alternating ion charges may be repeated in a cyclical manner during the advancement of the web 252. Alternating ion charges within the spray 506 enhances the removal of particles from the backside 258 of the web 252 as the static attraction of both negatively and positively charged particles to the web are neutralized by the spray 506. An ion generator that may be adapted to provide the spray 506 is available from Ion System, Inc. of Berkeley, Calif.

Figure 6:
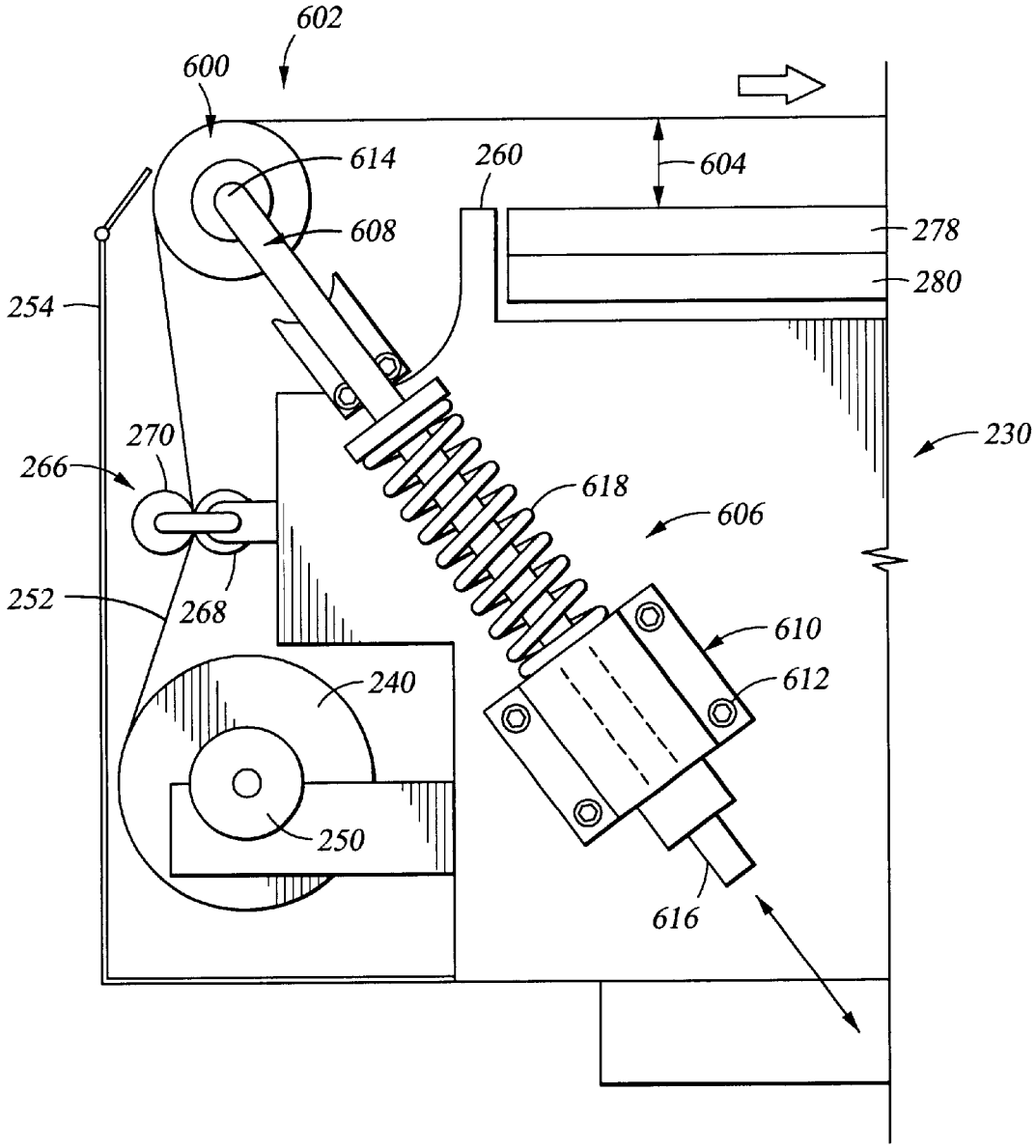
FIG. 6 is a sectional view of another embodiment of a cleaner.

FIG. 6 depicts another embodiment of a cleaner 600 that is disposed on a lift assembly 602. The illustrated cleaner 600 is substantially similar to the cleaner 108 described with reference to FIG. 2. Alternatively, other configurations of cleaners 600 may be utilized, for example, configurations including brushes, vacuums and fluid jets.

The lift assembly 602 generally includes the cleaner 600 that may be actuated into an extended position. In the extended position, the cleaner 600 lifts the web 252 of polishing material into a spaced-apart relation with the top surface 260 of the platen 230 (and subpad 278) defining a gap 604. In the extended position, the web 252 is separated from the top 260 of the platen 230 during advancement of the web 252. The cleaner 600 disposed on the lift assembly 602 removes particulates from the backside 258 of the web 252 as the web is advanced. Additionally, as the web 252 is suspended above the platen 230 during advancement, the probability of the web 252 being re-contaminated by coming in contact with the top of the platen 230 is reduced.

The lift assembly 602 generally includes the cleaner 600 and an actuator 606 for moving the cleaner 600 between the extended position shown in FIG. 6 and a retracted position (not shown) . The actuator 606 may include gas pots, springs, linear actuators, pneumatic cylinders, hydraulic cylinders, ball screws, solenoids, and other motion control devices.

In one embodiment, the lift assembly 602 includes a rod 608 and bearing block 610. The rod 608 is slidably disposed in the bearing block 610 that is coupled to the platen 230 via a plurality of mounting screws 612. The block 610 may have solid, roller or ball bearings such as a pillow block.

The rod 608 has a first end 614 and a second end 616. The first end 614 of the rod 608 is coupled to the cleaner 600. A bearing 620 may be disposed between the rod 608 and cleaner 600 to enhance the rotation of the cleaner 600 when in the extended position.

In one embodiment, the cleaner 600 is a roller having double sided tape disposed thereon. Alternatively, the cleaner 600 may be a brush, a fluid delivery tube, a vacuum, or an electrostatic member.

A spring 618 or other energy storage or motion device provides the force to extend the rod 608. Such devices include pneumatic cylinders, solenoids, hydraulic cylinders, compression springs, belleville washers, elastomers and the like. In one embodiment, the spring 618 comprises a coil spring. The spring 618 is selected to provide the force and travel needed to move the web 252 into the spaced-apart relation with the platen 230 when the slip-clutch 250 (and indexer 266) feeds out a length of web 252 and to maintain the gap 604 while the web is advanced across the platen 230.

Figure 7:
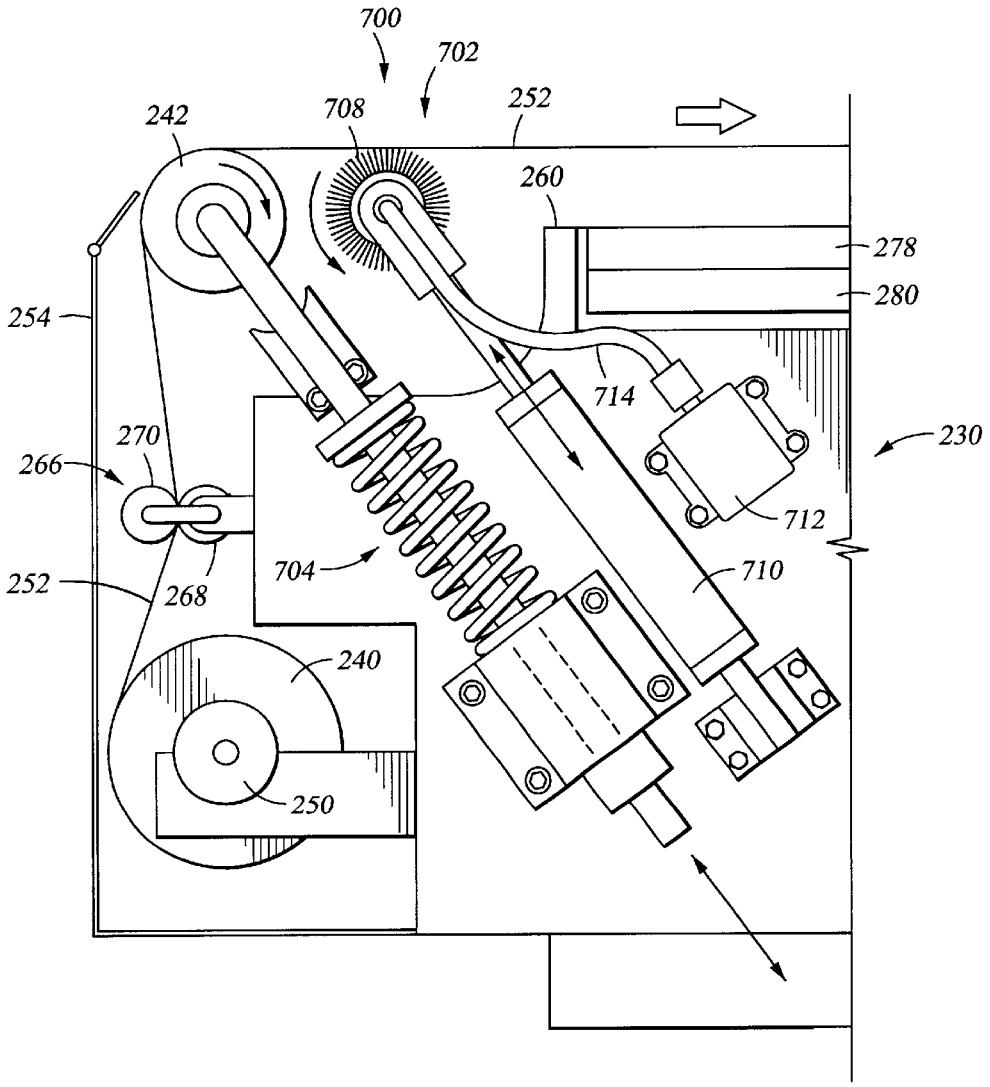
FIG. 7 is a sectional view of another embodiment of a cleaner.

FIG. 7 depicts another embodiment of a platen 230 having a cleaner 700. Generally, the platen 230 includes a first lift assembly 704 and a second lift assembly 702. The illustrative first lift assembly 704 is substantially similar to the lift assembly 602 described with reference to FIG. 6 except that the cleaner 600 is replaced with a roller 242 that guides a web 252 across the platen 230. The first lift assembly 704 may be actuated to place the web 252 disposed thereon in a spaced-apart relation to the platen 230. The second lift assembly 702 may be actuated to place the cleaner 700 in contact with the web 252 to facilitate cleaning of the backside of the web 252.

More specifically, the second lift assembly 702 is disposed adjacent to the first lift assembly 704 on one side of the platen 230. The second lift assembly 702 is typically coupled between the first lift assembly 704 and the platen 230. When the first lift assembly 702 is actuated to place the roller 242 in the extended position, a gap is defined between the web 252 and platen 230. The gap assists in facilitating movement of the web 252 over the platen 230.

The second lift assembly 702 is generally extended and retracted in concert with the first lift assembly 704. When the web 252 is lifted above the platen 230 by the first lift assembly 704, the second lift assembly 702 places the cleaner 700 in contact with the backside 258 of the web 252. Alternatively, the second lift assembly 702 may be actuated independently to have the cleaner 700 contact the web 252 when desired.

In one embodiment, the cleaner 700 is substantially similar to the cleaner 300 described with reference to FIG. 3. Alternatively, other configurations of cleaners 700 may be utilized, for example, configurations including tacky rollers, electrostatic rollers, vacuums and fluid jets. The cleaner 700 generally includes a brush 708 that is coupled to an actuator 710 (i.e., a pneumatic cylinder) of the second lift assembly 702. The brush 708 generally contacts the backside 258 of the web 252 when the second lift assembly 702 is in the extended position. Optionally, the brush may contact the roller 242 when the first and second lift assemblies 704, 702 are in various positions (i.e., both extended, both retracted or one retracted and one extended).

The brush 708 is generally driven in a direction tangentially opposed to the direction of web advancement. The brush 708 is typically coupled to a motor 712 by a belt or flexible shaft 714. The brush 708 is rotated to remove particulate that may be present on the backside of the web 252.

Figure 8:
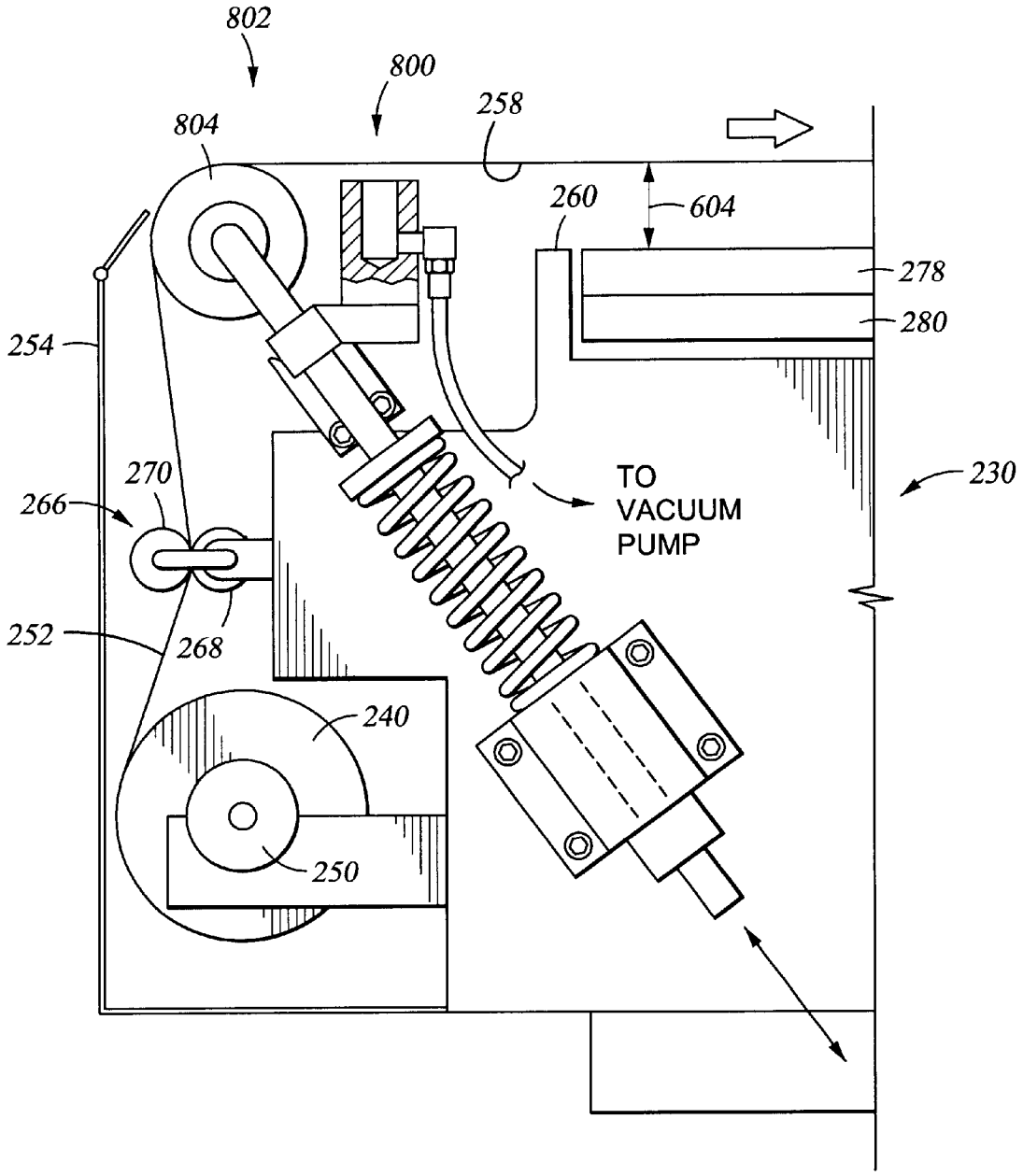
FIG. 8 is a sectional view of another embodiment of a cleaner.

FIG. 8 depicts another embodiment of a cleaner 800. Generally, a lift assembly 802 that includes a roller 804 is utilized to place the web 252 in a spaced-apart relation to the platen 230 when the web 252 is advanced. The cleaner 800, illustrated as a vacuum but may comprises other types of cleaners as described herein, is coupled to the lift assembly 802 such that the cleaner 800 travels together with the roller 804 and maintains contact with the backside 258 of the web 252 without need for a second lift assembly.

As the cleaners described herein removes contaminants from the backside 258 of the web 252 and optionally the surface of the roller 242, the amount of particulate contamination under on the backside 258 of the web 252 is minimized. The reduction of particulates between the backside 258 and the subpad 278 enhance the polishing performance, extend the life of the web 252 and contribute towards minimizing substrate defects.

Although the teachings of the present invention that have been shown and described in detail herein, those skilled in the art can readily devise other varied embodiments that still incorporate the teachings and do not depart from the scope and spirit of the invention.

What is claimed is:

1. Apparatus for supporting a web of polishing media having a polishing side and a backside, the apparatus comprising:

a platen having a support surface adapted to support the backside of the web; and a web cleaner coupled to the platen adjacent the backside of the web and disposed between a supply roll of unused polishing media and the platen.

2. The apparatus of claim 1, wherein web cleaner comprises a brush, a fluid delivery tube, a vacuum, a tacky roller, an electrostatic member or a combination thereof.

3. The apparatus of claim 1, wherein the web cleaner comprises:

a cylindrical or flat brush.

4. The apparatus of claim 1, wherein the web cleaner comprises:

a rotating brush contacting the web in a direction tangentially opposed to a direction of web advancement.

5. The apparatus of claim 1, wherein web cleaner comprises:

a brush or a tacky roller having an extended position and retracted position, the brush or roller placing the web in a spaced-apart relation to the support surface when in the extended position.

6. The apparatus of claim 1 further comprising:

a first lift assembly having an extended position and retracted position, the first lift assembly placing the web in a spaced-apart relation to the support surface when in the extended position; and a second lift assembly having an extended position and retracted position, the second lift assembly having the web cleaner disposed thereon.

7. The apparatus of claim 1, wherein the web cleaner comprises:

a fluid delivery tube having a plurality of apertures, the apertures flowing a fluid that sprays the backside of the web.

8. The apparatus of claim 7, wherein the fluid is deionized water, air or nitrogen.

9. The apparatus of claim 7, wherein the fluid is ionized air that is alternatively composed of predominantly positive ions and predominantly negative ions.

10. The apparatus of claim 1, wherein the web cleaner comprises:

a fluid delivery tube coupled to the platen proximate an edge of the web, the tube having at least one aperture, the aperture flowing a fluid that sprays laterally across the backside of the web.

11. The apparatus of claim 1, wherein web cleaner comprises:

a fluid delivery tube having an extended position and retracted position, the fluid delivery tube placing the web in a spaced-apart relation to the support surface when in the extended position.

12. The apparatus of claim 1, wherein the web cleaner comprises:

a fluid delivery tube having one or more nozzles adapted to dispose a fluid on a side of the web supported by the support surface of the platen.

13. The apparatus of claim 1 further comprising:

a roller disposed adjacent the cleaner that supports the web on one side of the platen, the roller contacting the cleaner.

14. The apparatus of claim 1, wherein the cleaner is between the backside of the web and the platen.

15. Apparatus for supporting a web of polishing media having a polishing side and a backside, the apparatus comprising:

a platen having a support surface adapted to support the web of polishing media; and a means for cleaning the backside of the web, the means being coupled to the platen and disposed between a supply roll of unused polishing media and the platen.

16. The apparatus of claim 15, wherein the means comprises a brush, a fluid delivery tube, a vacuum, a tacky roller, an electrostatic member or a combination thereof.

17. The apparatus of claim 15, wherein the means comprises a fluid delivery tube having a plurality of apertures spraying ionized air that is alternatively composed of predominantly positive ions and predominantly negative ions.

18. A processing system comprising:

one or more webs of polishing material, each web having a polishing side and a backside;

one or more polishing heads each adapted to retain a substrate against a respective web in a polishing pattern;

one or more platens having a support surface having the backside of the web disposed thereon; and a web cleaner coupled to at least one of the one or more platens and disposed between a supply roll of unused polishing media and the platen, wherein the backside of the web is disposed proximate the web cleaner.

19. The apparatus of claim 18, wherein the web cleaner comprises a brush, a fluid delivery tube, a vacuum, a tacky roller, an electrostatic member or a combination thereof.

20. The apparatus of claim 18 further comprising:

a first lift assembly having an extended position and retracted position, the first lift assembly placing the web in a spaced-apart relation to the support surface when in the extended position; and a second lift assembly having an extended position and retracted position, the second lift assembly having the web cleaner disposed thereon.

21. The apparatus of claim 18, wherein the web cleaner comprises:

a fluid delivery tube having a plurality of apertures, the apertures flowing a fluid that sprays the backside of the web.

22. The apparatus of claim 21, wherein the fluid is deionized water, air or nitrogen.

23. The apparatus of claim 21, wherein the fluid is ionized air that is alternatively composed of predominantly positive ions and predominantly negative ions.

24. The apparatus of claim 21, wherein the web cleaner comprises:

a fluid delivery tube coupled to the platen proximate an edge of the web, the tube having at least one aperture, the aperture flowing a fluid that sprays laterally across the backside of the web.

25. A method for cleaning the backside of a web of polishing media, comprising the steps of:

supporting a portion of the web of polishing media on a platen;

cleaning an unused portion of a backside of the web; and advancing the web onto the platen;

wherein the step of cleaning the unused portion of the web further comprises applying at least one of tacky roller;

or an electrostatic charge to the backside of the web.

26. The method of claim 25, wherein the step of cleaning further comprises the step of:

disposing a brush in contact with the backside of the web; and, rotating the brush in a direction tangentially opposed to a direction of web advancement at the point of contact between the brush and the web.

27. The method of claim 25, wherein the step of cleaning the backside of the web further comprises the step of cleaning a roller supporting the web.

28. The method of claim 25 further comprising the step of:

moving a cleaner to an extended position that places the web in a spaced-apart relation to the platen.

29. The method of claim 25, wherein the step of cleaning further comprises the step of cleaning the unused portion of the web prior to advancing that portion of the web onto the platen.

30. The method of claim 25, wherein the step of cleaning the unused portion of the web further comprises applying one or more of a brush, a vacuum, or a spray of cleaning fluid to the backside of the web.

* * * * *

UNITED STATES PATENT AND TRADEMARK OFFICE

CERTIFICATE OF CORRECTION

PATENT NO. : 6,659,849 B1
DATED : December 9, 2003
INVENTOR(S) : Li et al.

It is certified that error appears in the above-identified patent and that said Letters Patent is hereby corrected as shown below:

Column 5,
Line 46, please change “and.the” to -- and the --.

Column 7,
Line 10, please change “rush” to -- brush --.

Signed and Sealed this

Eighth Day of June, 2004

JON W. DUDAS
*Acting Director of the United States Patent and Trademark Office*